US009802677B2

(12) United States Patent
Simola

(10) Patent No.: US 9,802,677 B2
(45) Date of Patent: Oct. 31, 2017

(54) FLOATING PLATFORM MODULE

(71) Applicant: Charles Simola, Speculator, NY (US)

(72) Inventor: Charles Simola, Speculator, NY (US)

( * ) Notice: Subject to any disclaimer, the term of this patent is extended or adjusted under 35 U.S.C. 154(b) by 0 days.

(21) Appl. No.: 15/008,967

(22) Filed: Jan. 28, 2016

(65) Prior Publication Data

US 2016/0214683 A1 Jul. 28, 2016

Related U.S. Application Data

(60) Provisional application No. 62/108,706, filed on Jan. 28, 2015.

(51) Int. Cl.

| | |
|---|---|
| ***B63B 35/44*** | (2006.01) |
| ***B63B 35/58*** | (2006.01) |
| ***B63B 3/18*** | (2006.01) |
| ***B63B 3/06*** | (2006.01) |

(52) U.S. Cl.

CPC ..... *B63B 3/185* (2013.01); *B63B 3/06* (2013.01)

(58) Field of Classification Search

CPC B63B 35/44; B63B 3/185; B63B 3/06; B63B 17/00; B63C 1/02; E02B 3/06; E01D 15/14; F16K 15/00

USPC ..... 114/263, 266; 441/53

See application file for complete search history.

(56) References Cited

U.S. PATENT DOCUMENTS

| | | | | |
|---|---|---|---|---|
| 755,854 | A | 3/1904 | Dieckhoff | |
| 903,598 | A | 11/1908 | Mehlhorn et al. | |
| 3,004,391 | A | 10/1961 | Miller | |
| 3,131,542 | A | 5/1964 | Koch | |
| 3,323,479 | A | 6/1967 | Filak | |
| 3,760,754 | A | 9/1973 | Drummond | |
| 4,548,153 | A * | 10/1985 | Watchorn | B63B 5/14 114/267 |
| 4,920,907 | A | 5/1990 | Richter | |
| 5,281,055 | A | 1/1994 | Neitzke | |
| 5,915,325 | A | 6/1999 | Gerber | |
| 6,138,600 | A | 10/2000 | Berquist | |
| 6,381,792 | B1 * | 5/2002 | Woodfin | E01D 15/14 14/2.6 |

OTHER PUBLICATIONS

PCT International Search Report of International Application No. PCT/US2016/015356 dated Apr. 28, 2016.

* cited by examiner

*Primary Examiner* — Anthony Wiest

(74) *Attorney, Agent, or Firm* — Bond Schoeneck & King, PLLC; George McGuire

(57) ABSTRACT

A floating module includes an upper half and a lower half. The upper half includes one edge from which a flange extends downwardly, while the lower half includes an opposite edge that includes an upwardly facing flange. Modules can be interconnected to one another by engaging the upper flange from one with the lower flange from another. A cavity and channels are formed in the lower surface of the module such that water will become entrapped in the cavity and channels when the platform is placed in water. Through use of one way check valves positioned in fluid communication with the cavity and channels, a hydro-lock is formed that prevents the water from escaping the cavity and channels while it is placed in water.

19 Claims, 9 Drawing Sheets

FLOATING PLATFORM MODULE

REFERENCE TO RELATED APPLICATION

The present application relates and claims priority to applicant's co-pending U.S. Provisional Application, Ser. No. 62/108,706, filed Jan. 28, 2015, the entirety of which is hereby incorporated by reference.

BACKGROUND

1. Field of Invention

The present invention relates generally to floating platform modules, and more particularly to a floating platform module that can be used in isolation or joined with other like modules to form a customized floating platform of desired size and configuration.

2. Background of Art

Floating platforms, coupled with support structure and decking are used for many marine purposes. Common applications of such a float are in its use as a floating dock, a boat slip, a platform for employment of a marine tool, and the like.

Floating docks, for example, are commonly used in bodies of water that are susceptible to significant changes in water depth, as well as in locations where it is desirable to remove a dock for maintenance and/or seasonal reasons. Due to a floating dock having the property of rising and falling with the level of the water, at least to a limited degree, wave action, and rising and falling tides, the damage that oftentimes will occur to a boat that is tied to a fixed dock is far less severe when the dock also changes its level with the change in water depth. In addition, in those areas where, for example, ice forms along the shore lines during colder months, damage may be done to a permanently installed dock, whereas a floating dock is generally removable from the water so that it can be properly maintained and not subjected to the damage caused by freezing and thawing of the water.

One drawback to floating docks, as compared to their fixed counterparts, is that the floating docks are less stable due to buoyancy being the primary force that maintains them in position, as opposed to concrete pilings or other solid foundational structure. Thus, improvements to the stability of floating docks are always a desired innovation.

3. Objects and Advantages

It is a primary object and advantage of the present invention to provide a stable floating platform module.

It is a further object and advantage of the present invention to provide a module that may be interconnected to other modules to form a stable floating platform of desired size and configuration.

It is an additional object and advantage of the present invention to provide a floating platform module to which deck board may be easily attached and detached when desired.

Other objects and advantages of the present invention will in part be obvious and in part appear hereinafter.

SUMMARY OF THE INVENTION

In accordance with the foregoing objects and advantages, the present invention provides a floating platform module and system of platform modules from which a floating platform of desired size and configuration may be constructed. The floating platform module and any floating platform constructed from the modules are stable when placed in water.

In an aspect of the invention, a floating platform module includes an upper section having an upwardly facing surface and a first elongated edge; a lower section having a downwardly facing surface and a second elongated edge that is positioned opposite from the first elongated edge; a first flange extending downwardly from the first elongated edge; a second flange extending upwardly from the second elongated edge; first and second channels formed in the lower section each of a first predetermined depth and shape, the first channel extending co-linearly with the second elongated edge and the second channel extending parallel to and adjacent the first elongated edge; and a cavity formed in the lower section between the first and second channels and of a second predetermined depth and size. When placed in water, the buoyancy of the platform module will cause it to partially sink such that the water level rises to a predetermined depth along its sidewalls. Water will enter the first and second channels and the cavity, which will serve to stabilize the platform.

In one embodiment, the platform module further includes several air holes formed therethrough and in which are positioned one way check valves. The air holes and check valves are positioned and oriented in relation to the first and second channels and the cavity such that air will be forced through the check valves when the platform is submerged and as water fills the channels and the cavity, no air will be able to pass, thereby creating a hydro-lock that entraps the water within the channels and the cavity. An optional vacuum pump may also be employed to vacate any residual air that might otherwise remain present in the channels and the cavity.

In one embodiment, the predetermined shape of the first and second channels is triangular with an upwardly extending slot. When the platform module is placed in water, the water level remains at a height that is below the height of the slot. Thus, the water entrapped in the channels will be at a height higher than the external water level in which the platform is floating, thereby adding further stability to the platform when a load is placed thereupon.

In another aspect, several floating platform modules may be joined together into a desired size and configuration, thereby permitting custom-sized and shaped docks to be assembled using the modules. To protect the modules against damage from shifting in the water and rubbing or bumping into one another, rubber bumpers may be installed along the edges of the modules to absorb any such vibrations.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 6:
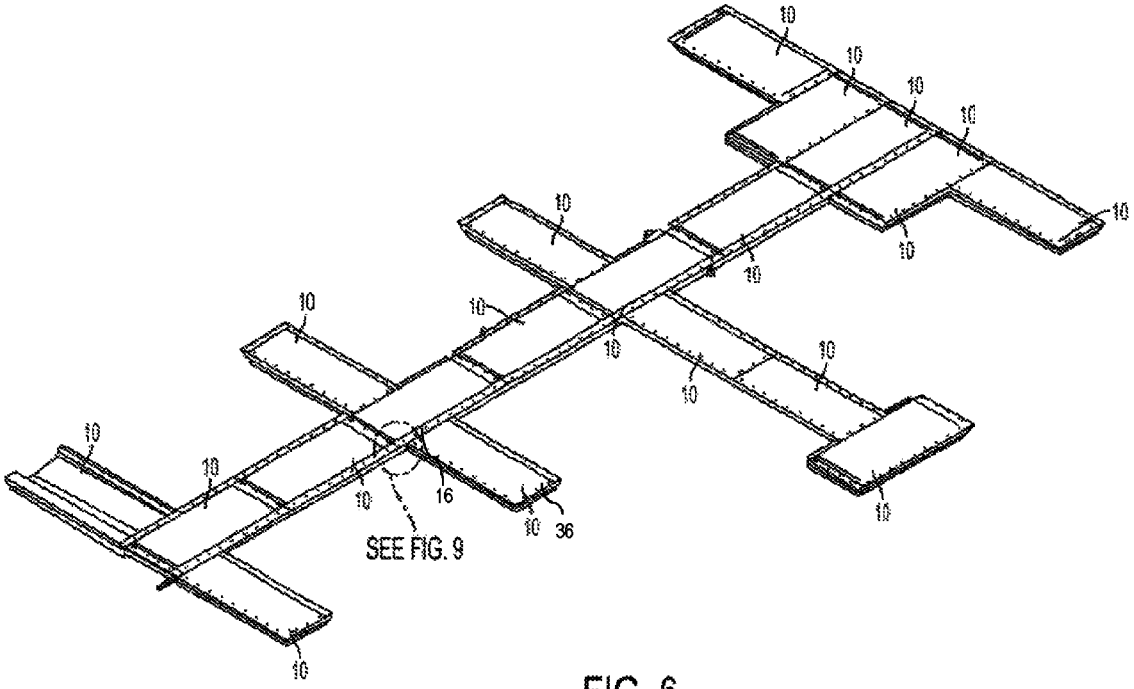
FIG. 6 is a perspective view of several floating platform modules joined together to form a larger floating structure in accordance with an aspect of the invention.
Figure 7:
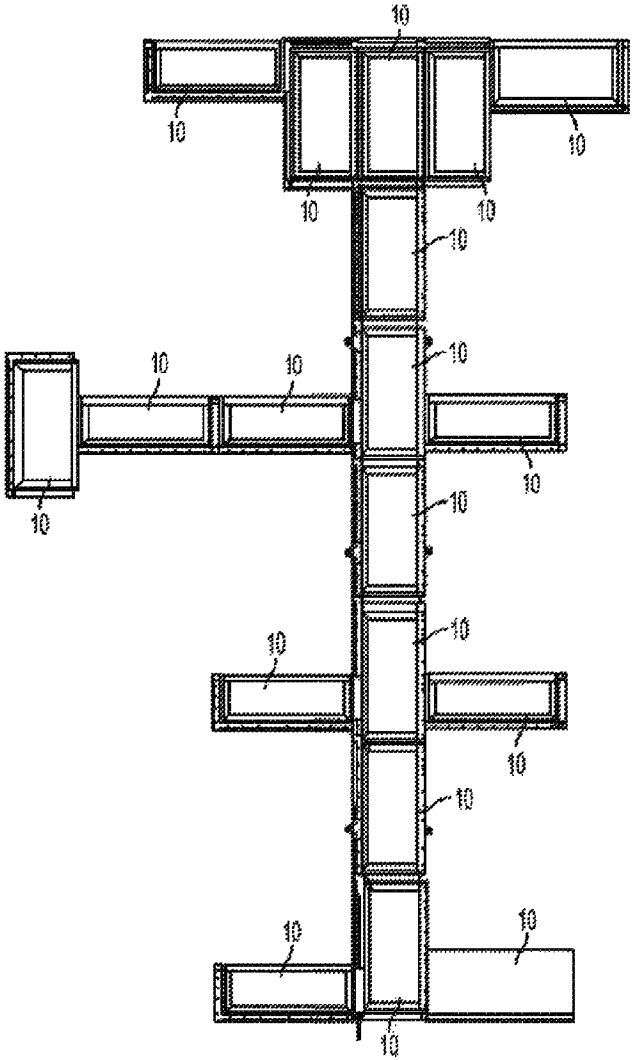
FIG. 7 is a top plan view thereof.
Figure 8:
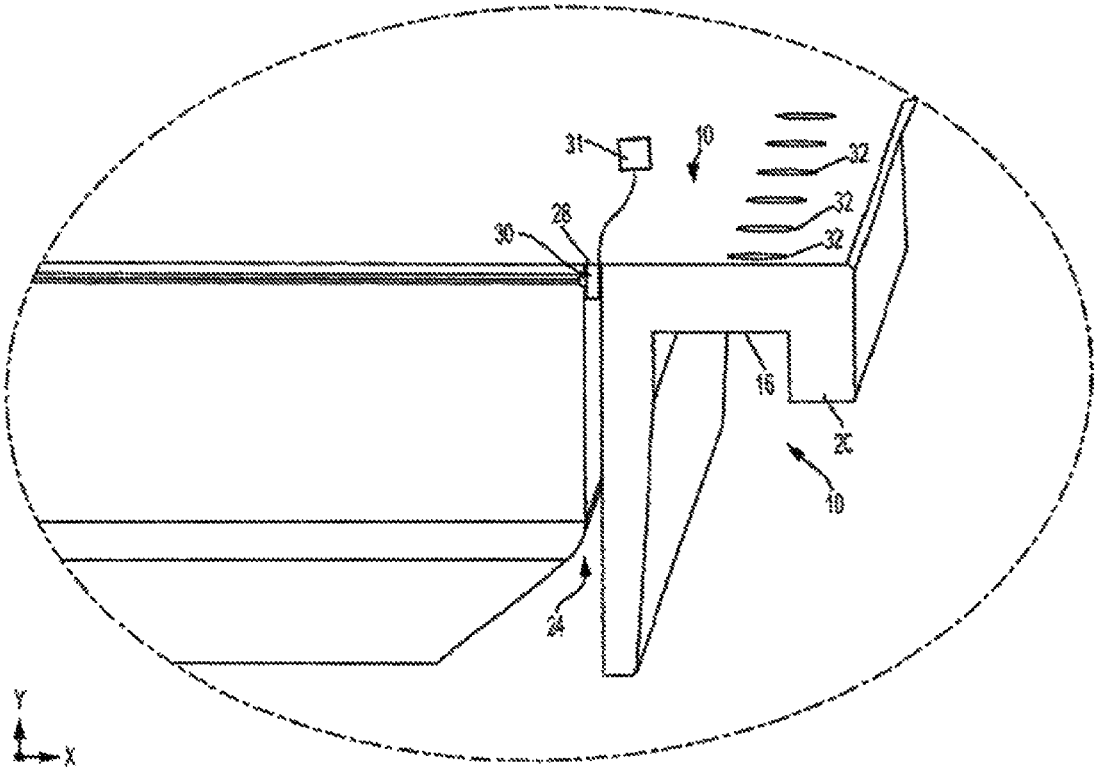
FIG. 8 is an enlarged partial view taken at the encircled portion from FIG. 1.

Referring now to the drawing figures, wherein like reference numerals refer to like parts throughout, a floating platform module, designated generally by reference numeral 10, is provided and shown in FIGS. 1-6. Floating platform module 10 may be interconnected to other modules 10 to form a floating platform of desired size and configuration as shown in FIGS. 6 and 7. In addition, while platform module 10 includes the necessary float, support structure and platform to be applied as a floating dock or other marine support structure, it could be applied merely as a float with additional structure and/or platform surfaces integrated therewith.

Figure 9:
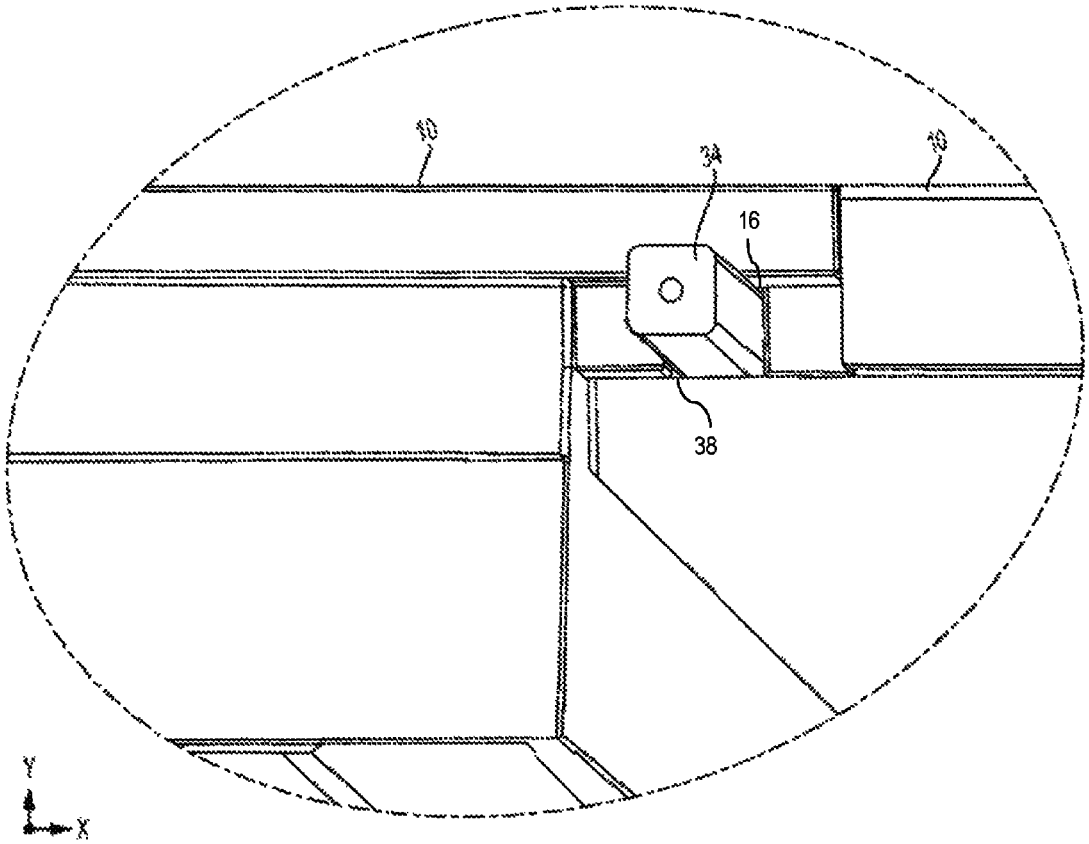
FIG. 9 is an enlarged partial view taken at the encircled portion from FIG. 6.

Floating platform module 10 comprises an integral unit composed of two halves: an upper portion 12 and a base 14 (it should be noted that while in its preferred form this is composed of a single unitary construction, it could be two (or more) separate pieces joined together). Upper portion 12 and base 14 are arranged such that a first elongated edge 16 of upper portion 12 overhangs base 14 and the opposing parallel second elongated edge 18 of base 14 extends beyond the corresponding edge of upper portion 12. A flange 20 extends downwardly from and across the first elongated edge 16, while a flange 22 extends upwardly from and across the edge of the second elongated edge 18. When interconnecting two modules together, flange 20 from one module 10 will engage flange 22 from the adjacent module 10 to provide a portion of the secure interconnection between the two modules. For example, as shown in FIGS. 6 and 9, flange 20 extending from a first elongated edge 16 of a first module engages with flange 22 of a fourth elongated edge 38 of a second module. The second elongated edge 18 of the first module and the third elongated edge 36 of the second module may each also connect similarly an additional module.

Figure 1:
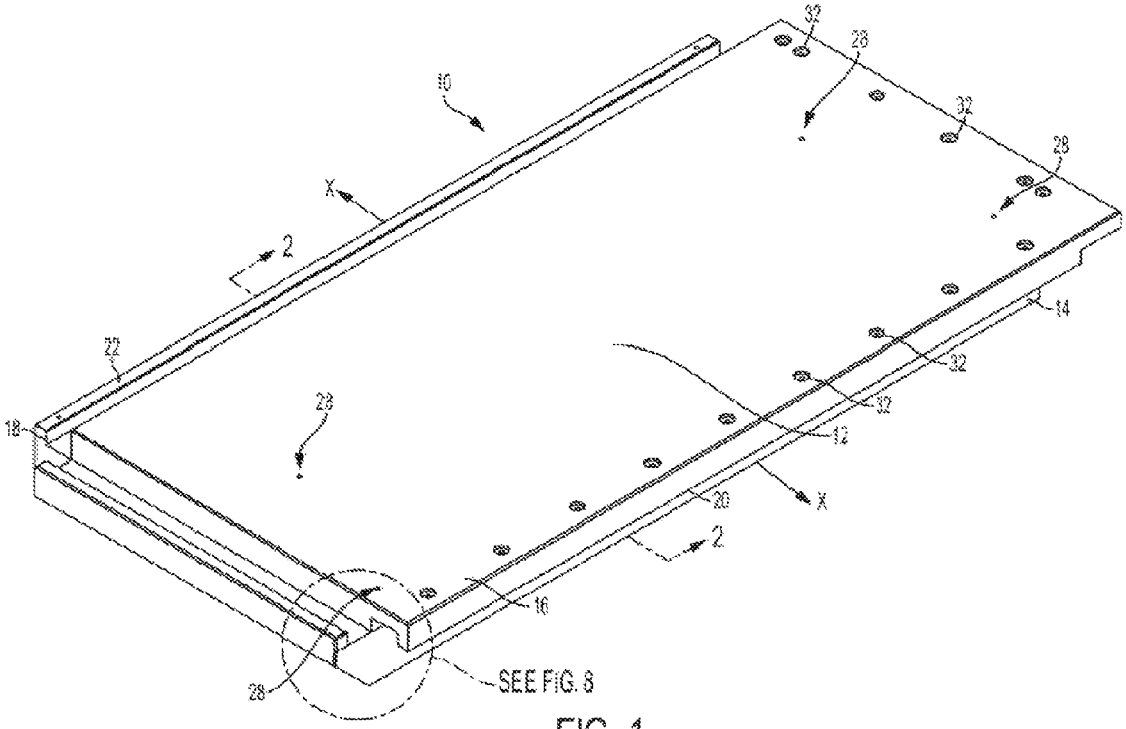
FIG. 1 is a perspective view of a floating platform module in accordance with an aspect of the invention.
Figure 2:
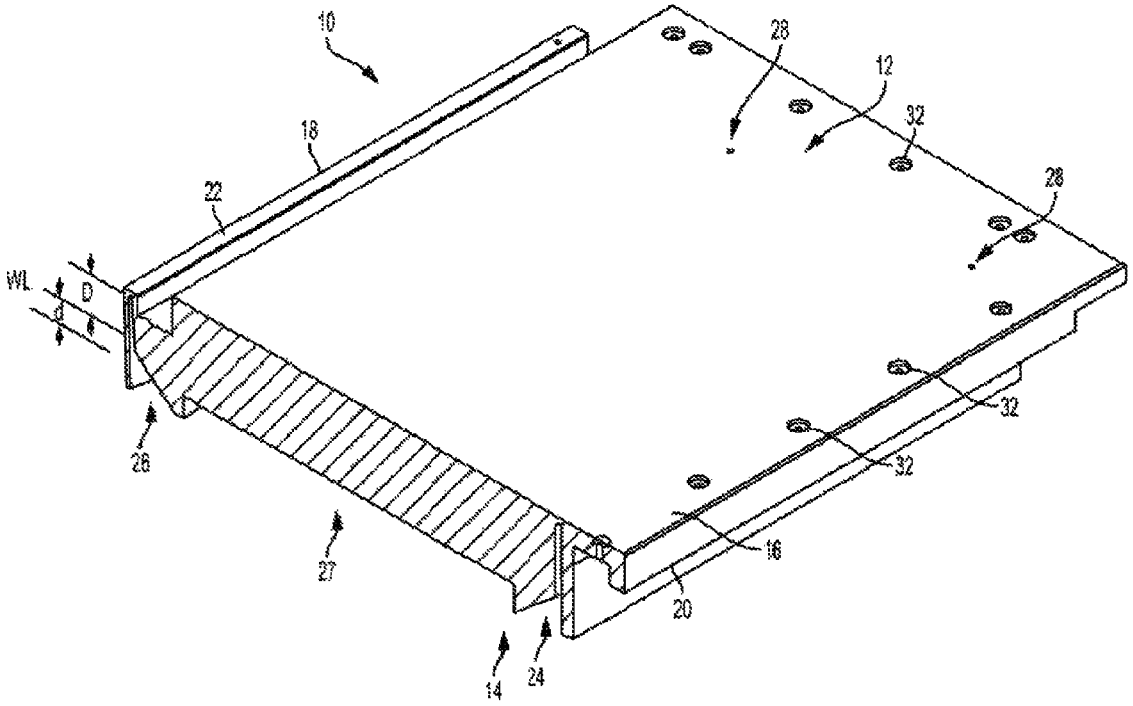
FIG. 2 is a cross-sectional view taken along section line 2-2 of FIG. 1.
Figure 3:
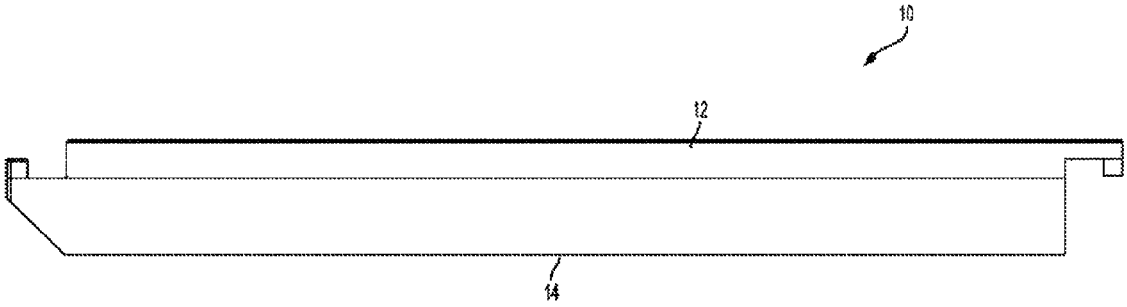
FIG. 3 is an end elevation view thereof.
Figure 4:
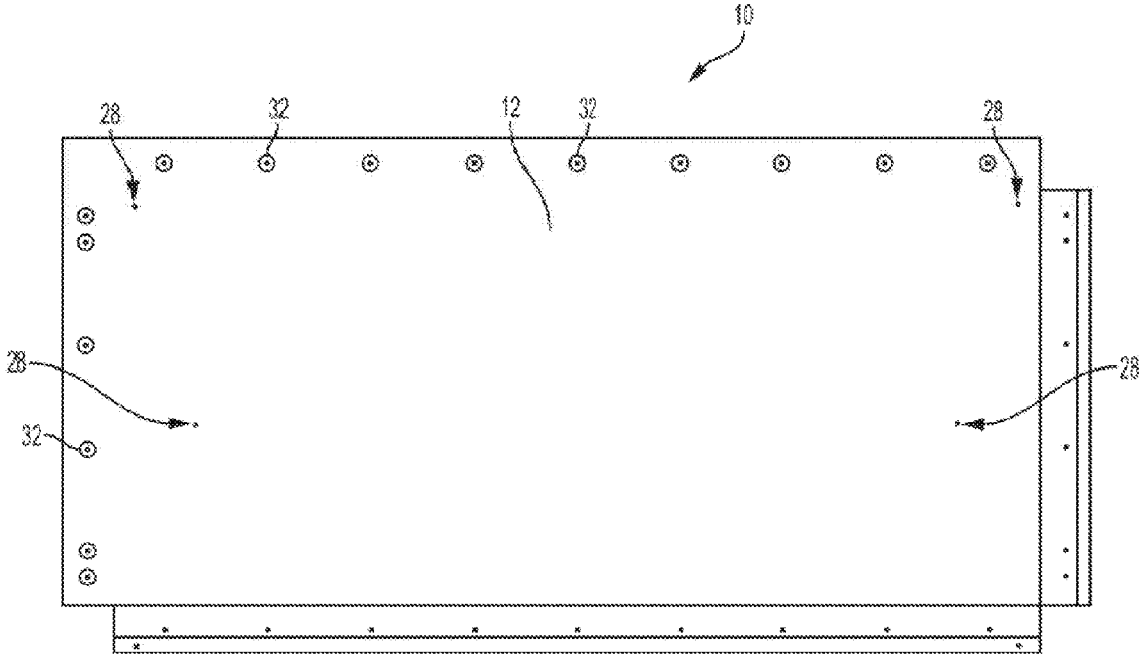
FIG. 4 is a top plan view thereof.
Figure 5:
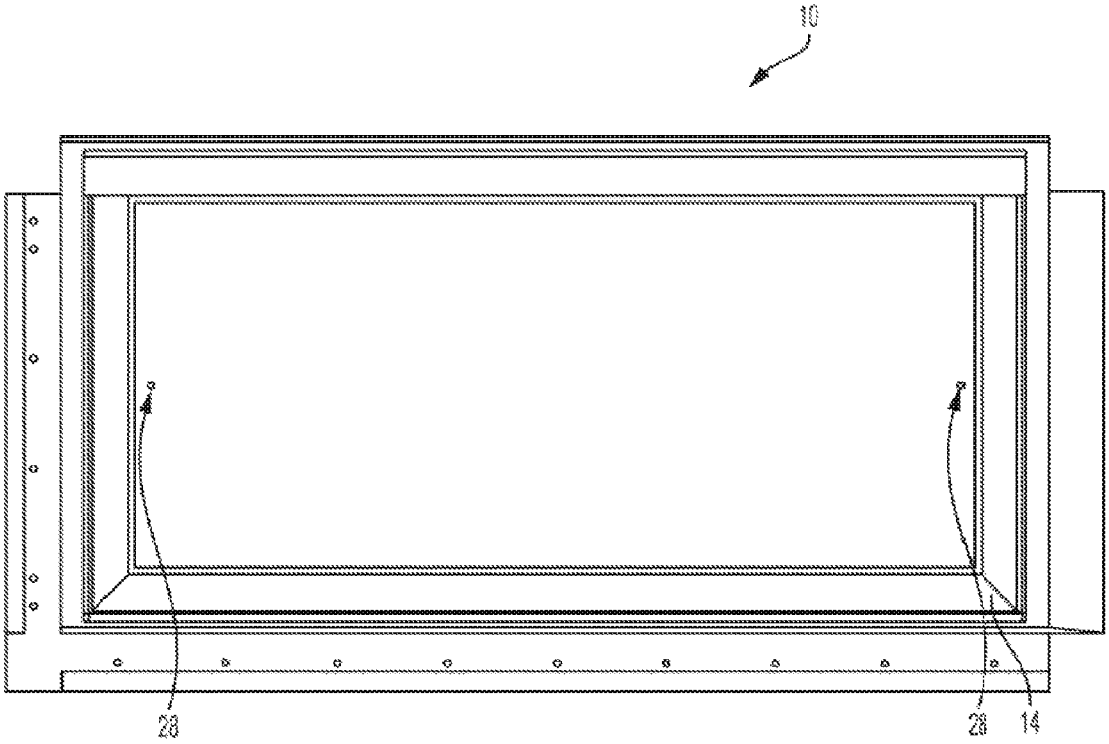
FIG. 5 is a bottom plan view thereof.

As seen most clearly in FIG. 2, the bottom surface of base 14 comprises channels 24, 26 that extend along opposing edges thereof, parallel to the longitudinal axis X-X of module 10, with channel 26 extending into flange 22. Channels 24 and 26 are each triangularly formed but with an elongated slot extending beyond the end of the triangular form in a plane that is transverse to the plane in which module 10 extends. When placed into water, platform module will partially sink into the water to a level where the water level, WL, is above bottom surface by a predetermined amount (e.g., 4"-6"). When partially submerged, water will fill channels 24 and 26 to provide stability to module 10 as it floats in the water. In addition, the central section of the bottom surface of base 14 is also formed with a cavity 27 to provide further stability to module 10 when floating in water. Relative to the water levels, the upwardly extending slot formed in channels 24 and 26 extends a predetermined distance, D, above the water level line. In one embodiment, the depth of cavity 27 is a predetermined distance, d, below the water level line, WL. The relative distances d and D provided by channels 24 and 26 and cavity 27 with respect to the water level line WL, serve to stabilize platform module 10 in the water even if when a load is placed thereupon (e.g., by a person walking on it). In an alternate embodiment, cavity 27 will be formed such that its depth will extend above the water line WL. By evacuating the air in the space above the water line and allowing it to fill with water, the additional water will serve as further ballast to help stabilize the platform.

With regard to FIGS. 1, 4, 5, and 8, a series of air holes 28 are formed through module 10 and extend into channels 24 and 26 and cavity 27. In each air hole is a one way check valve 30 that permits air to exit from the channels and the cavity, but not enter from above. Thus, as water fills channels 24 and 26 and cavity 27, the air is pushed through check valves 30 until water entirely fills them. As no air can get back through the check valves 30, the water becomes trapped in the cavity and channels; thereby further adding dead weight and thus stability of module 10 is water. As a further aspect, an optional vacuum pump 31 (see FIG. 8) may be employed to vacate any residual air that may otherwise remain in the channels and cavity or to use to pump water into the cavity and channels and ensure the cavity and channels are fully occupied with water.

A series of predrilled counter-sunk holes 32 are formed along two adjacent edges of the upwardly facing surface of upper portion 12. These openings 32 permit bulkheads to be quickly and easily attached to the platform.

It should be noted that the upwardly facing surface of platform module 10 is suitable for walking upon or placing a load upon without a need for attaching external boards or decking; if decking is desired for aesthetics, however, they may be easily and quickly attached With reference to FIGS. 6 and 7, a series of platform modules 10 may be interconnected to one another to form a larger platform of desired size and configuration, including one, as shown and for example purposes, that includes multiple boat slips. As seen in FIG. 9, between adjacent modules, tubular, rubber buffers 34 are positioned to absorb any shock from movement of one module 10 relative to an adjacent module 10. While bumper 34 is illustrated as being square in cross section, each may also be circular or other shape, and may include openings through which fasteners can pass to secure the interconnection of the bumper to the modules. As previously described, adjacent modules are positioned such that the flange 20 from one module overlaps with and engages the flange 22 from the adjacent module to further secure the interconnection between the two modules, or an overhanging edge from the upper section may extend over the flange 22 from the lower section with the bumper sandwiched between the two sections and fasteners used to secure the interconnection.

In another aspect, expandable foam may optionally be injected into the body of modules 10 during manufacture. The expandable foam provides an added level of buoyancy and density to the modules, further adding to the utility of the present invention.

What is claimed is:

1. A floating module, comprising:

a. an upper section having an upwardly facing surface and a first elongated edge;

b. a lower section having a downwardly facing surface and a second elongated edge that is positioned opposite parallel from said first elongated edge;

c. a first flange extending downwardly from said first elongated edge;

d. a second flange extending upwardly from said second elongated edge;

e. first and second channels formed in said lower section each of a first predetermined depth and shape, said first channel extending co-linearly with said second elongated edge and said second channel extending parallel to and adjacent said first elongated edge; and f. a cavity formed in said lower section between said first and second channels and of a second predetermined depth and size.

2. The floating module according to claim 1, further comprising a bumper connected to at least one of said first and second flanges.

3. The floating module according to claim 2, wherein said bumper is tubular.

4. The floating module according to claim 1, further comprising at least one check valve positioned in fluid communication with at least one of said first channel, second channel, and cavity.

5. The floating module according to claim 4, further comprising a vacuum pump operably attached in fluid communication to at least one of said first channel, second channel, and cavity.

6. The floating module according to claim 1, further comprising a plurality of countersunk openings formed in said upwardly facing surface of said upper section.

7. The floating module according to claim 1, wherein said first and second channels each include a triangular shaped cross-section portion and a linear, elongated shaped cross-section portion.

8. The floating module according to claim 1, wherein said first predetermined depth is larger than said second predetermined depth.

9. The floating module according to claim 1, wherein expandable foam is stored within said upper section and said lower section.

10. A modular floating platform, comprising:

a. a first floating module, comprising:

i. a first floating module upper section having a first upwardly facing surface and a first elongated edge;

ii. a first lower section having a second downwardly facing surface and a second elongated edge that is positioned opposite parallel from said first elongated edge;

iii. a first flange extending downwardly from said first elongated edge;

iv. a second flange extending upwardly from said second elongated edge;

b. a second floating module, comprising:

i. a second upper section having a second upwardly facing surface and a third elongated edge;

ii. a second lower section having a second downwardly facing surface and a fourth elongated edge that is positioned opposite parallel from said third elongated edge;

iii. a third flange extending downwardly from said third elongated edge;

iv. a fourth flange extending upwardly from said fourth elongated edge;

c. a bumper connected to and extending along said first flange;

d. wherein, said first flange of said first floating module securely engages said fourth flange of said second floating module, such that said bumper is between said first elongated edge and said fourth elongated edge.

11. The modular floating platform of claim 10, further comprising:

a. said first floating module further comprising:

i. first and second channels formed in said first lower section each of a first predetermined depth and shape, said first channel extending co-linearly with said second elongated edge and said second channel extending parallel to and adjacent said first elongated edge; and ii. a first cavity formed in said first lower section between said first and second channels and of a second predetermined depth and size;

b. said second floating module further comprising:

i. fourth and fifth channels formed in said second lower section each of said first predetermined depth and shape, said fourth channel extending co-linearly with said fourth elongated edge and said fifth channel extending parallel to and adjacent said third elongated edge; and ii. a second cavity formed in said lower section between said third and fourth channels and of said second predetermined depth and size.

12. The modular floating platform according to claim 11, further comprising at least one first check valve positioned in fluid communication with at least one of said first channel, second channel, and first cavity, and at least one second check valve positioned in fluid communication with at least one of said fourth channel, fifth channel, and second cavity.

13. The modular floating platform according to claim 12, further comprising a first vacuum pump operably attached in fluid communication to at least one of said first channel, second channel, and first cavity, and a second vacuum pump operably attached in fluid communication to at least one of said fourth channel, fifth channel, and second cavity.

14. The modular floating platform according to claim 11, wherein said first predetermined depth is larger than said second predetermined depth.

15. The modular floating platform according to claim 10, further comprising a second bumper connected to and extending along said second flange.

16. The modular floating platform according to claim 10, wherein said bumper is tubular in cross-section.

17. The modular floating platform according to claim 10, further comprising a first plurality of countersunk openings formed in said first upwardly facing surface of said first upper section, and a second plurality of countersunk openings formed in said second upwardly facing surface of said second upper section.

18. The modular floating platform according to claim 11, wherein said first, second, fourth and fifth channels each include a triangular shaped cross-section portion and a linear, elongated shaped cross-section portion.

19. The modular floating platform according to claim 10, wherein expandable foam is stored within said first and second upper sections and said first and second lower sections.

* * * * *